US006854667B2

(12) United States Patent
Ulrich et al.

(10) Patent No.: US 6,854,667 B2
(45) Date of Patent: Feb. 15, 2005

(54) SPRAY GUN HAVING INDEXING AIR CAP WITH QUICK RELEASE RETAINING RING

(75) Inventors: Mark E. Ulrich, Oak Grove, MN (US); Michael J. Reget, Plymouth, MN (US); John C. Sweazey, Eden Prairie, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 169 days.

(21) Appl. No.: 10/236,816

(22) Filed: Sep. 6, 2002

(65) Prior Publication Data

US 2003/0052190 A1 Mar. 20, 2003

Related U.S. Application Data

(60) Provisional application No. 60/317,834, filed on Sep. 6, 2001.

(51) Int. Cl.[7] ..... B05B 1/28

(52) U.S. Cl. ..... 239/288; 239/290; 239/526; 239/600

(58) Field of Search ..... 239/288, 290, 239/526, 600, 705

(56) References Cited

U.S. PATENT DOCUMENTS 4,660,774 A * 4/1987 Kwok et al. ..... 239/600
5,332,156 A * 7/1994 Wheeler ..... 239/288
6,460,787 B1 * 10/2002 Hartle et al. ..... 239/705

* cited by examiner

*Primary Examiner*—Steven J. Ganey
(74) *Attorney, Agent, or Firm*—Douglas B. Farrow

(57) ABSTRACT

Interlocking tabs are provided on the backside of a spray gun air cap to mate with corresponding slots in the barrel of the gun. The tabs and slots are spaced at 90° (or other spacing if desired) to confine the air cap to vertical or horizontal orientations. The barrel and retaining ring are provided with a custom coarse thread which both allows quicker removal and replacement of the air cap as well as substantially eliminating the ability to cross-thread the air cap on the barrel.

3 Claims, 3 Drawing Sheets

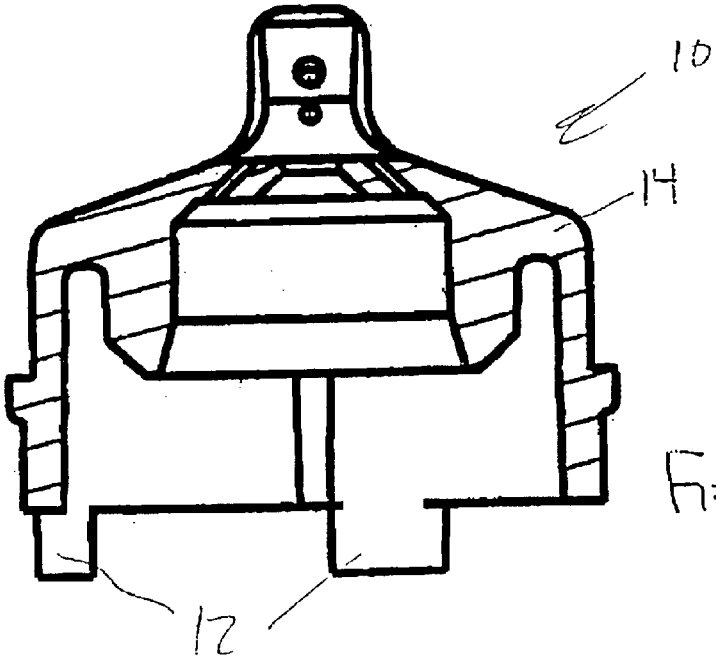
Fig 1
Fig 2
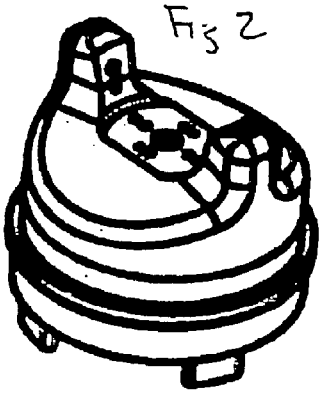
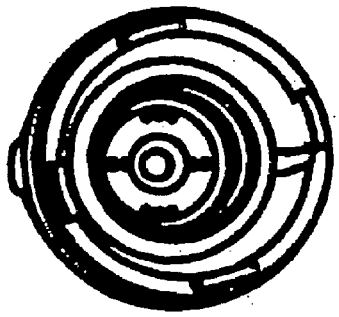
Fig 3

SPRAY GUN HAVING INDEXING AIR CAP WITH QUICK RELEASE RETAINING RING

RELATED APPLICATIONS

This application claims the benefit of U.S. Application Ser. No. 60/317,834, filed Sep. 6, 2001.

BACKGROUND OF THE INVENTION

Electrostatic spray guns have proven to be useful tools for efficient application of paints and coatings. While some current product has ball type detents to help position the air cap on such guns, most of the prior art has no positioning devices so that as the retaining ring is tightened, the air cap can rotate with the retaining ring this often resulting in a pattern which is slanted from the normally desired vertical or horizontal.

SUMMARY OF THE INVENTION

Interlocking tabs are provided on the backside of the air cap to mate with corresponding slots in the barrel of the gun. The tabs and slots are spaced at 90° (or other spacing if desired) to confine the air cap to vertical or horizontal orientations.

The barrel and retaining ring are provided with a custom coarse thread which both allows quicker removal and replacement of the air cap as well as substantially eliminating the ability to cross-thread the air cap on the barrel. Of course, the instant invention has equal applicability on non-electrostatic spray guns.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a cross-section of the air cap of the instant invention.

FIG. 2 is a top perspective view of the air cap of the instant invention.

FIG. 3 is a bottom perspective view of the air cap of the instant invention.

DESCRIPTION OF THE PREFERRED EMBODIMENT

Figure 4:
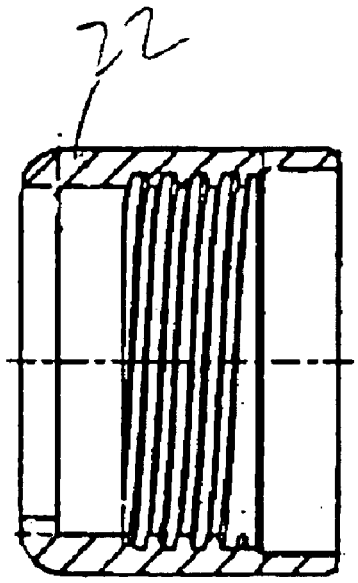
FIG. 4 is a cross-section of the retaining ring of the instant invention.
Figure 5:
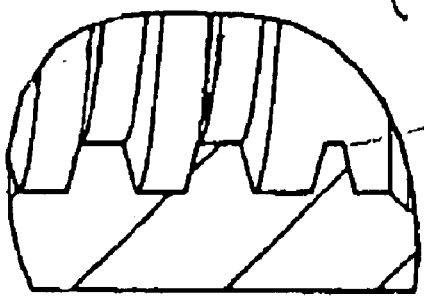
FIG. 5 is a cross-section detail of the thread of the retaining ring of the instant invention.
Figure 6:
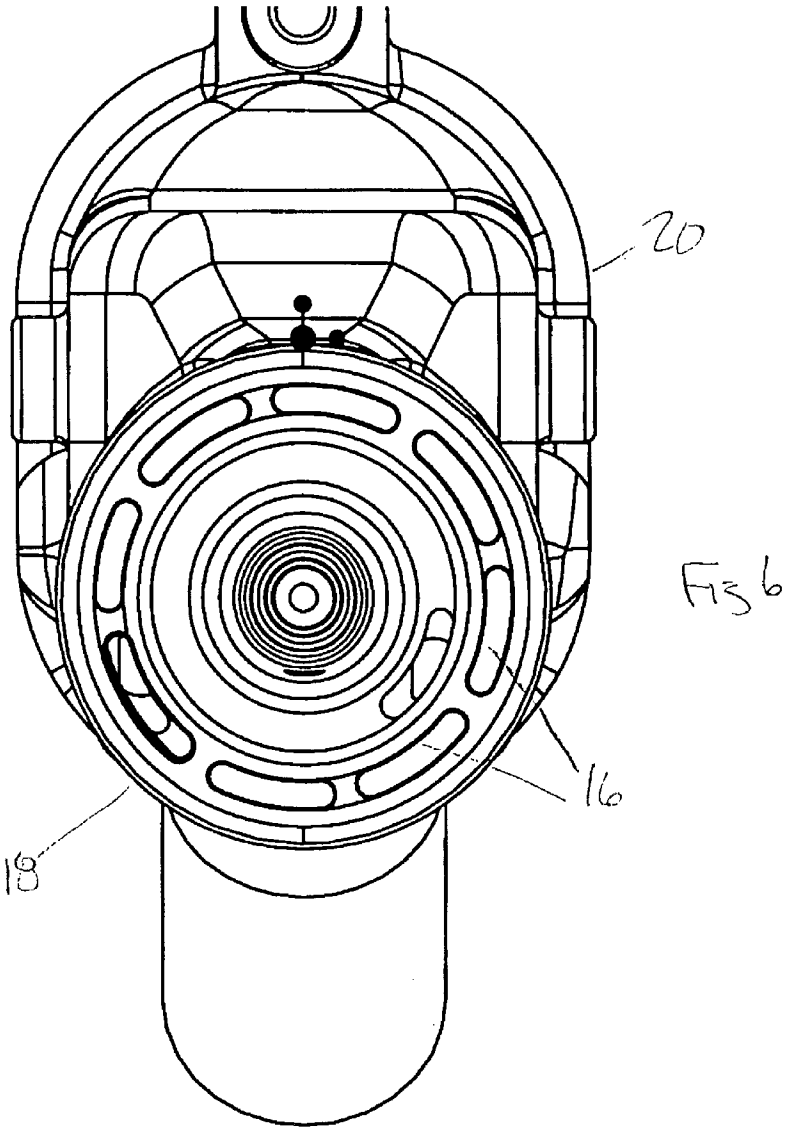
FIG. 6 is a front view of the barrel of the spray gun of the instant invention.

In the instant invention, generally designated 10, interlocking tabs 12 are provided on the backside of the air cap 14 to mate with corresponding slots 16 in the barrel 18 of the spray gun 20. The tabs and slots are spaced at 90° (or other spacing if desired) to confine the air cap to vertical or horizontal orientations.

The barrel 18 and retaining ring 22 are provided with a custom coarse thread which both allows quicker removal and replacement of the air cap as well as substantially eliminating the ability to cross-thread the air cap on the barrel. Of course, the instant invention has equal applicability on non-electrostatic spray guns. The double start thread has a pitch of 24 with a tooth angle of 29°. Major diameter is 1.519" while minor diameter is 1.415". The tooth base thickness is 0.077" while the distance between the upper edges of adjacent threads is 0.070"

It is contemplated that various changes and modifications may be made to the spray gun without departing from the spirit and scope of the invention as defined by the following claims.

What is claimed is:

1. In a spray gun having a barrel, an air cap and a retaining ring removably retaining said air cap on said barrel, the improvement comprising a plurality of tabs extending axially rearwardly from said air cap and a plurality of forwardly facing slots on said barrel for receiving said tabs thereby allowing said air cap to be rotated between a number of predetermined positions when said retaining ring is removed and fixed In one of said positions when said retaining ring is in place.

2. The spray gun of claim 1 wherein said retaining ring is removably engaged to said barrel with a coarse pitch thread.

3. The spray gun of claim 2 wherein said coarse thread has a pitch of about 24.

* * * * *